US005379824A

United States Patent [19]

Carvalho

[11] Patent Number: 5,379,824

[45] Date of Patent: Jan. 10, 1995

[54] DOUBLE WINDOW APPARATUS

[75] Inventor: Elmer R. Carvalho, Upland, Calif.

[73] Assignee: Hegwer Industries, Inc., Ontario, Calif.

[21] Appl. No.: 104,009

[22] Filed: Aug. 10, 1993

[51] Int. Cl.[6] ..... E06B 3/32

[52] U.S. Cl. ..... 160/90; 160/44; 49/63; 49/408

[58] Field of Search ..... 160/90, 91, 44; 49/63, 49/62, 408, 450

[56] References Cited

U.S. PATENT DOCUMENTS

| | | | |
|---|---|---|---|
| 2,640,535 | 6/1953 | Milone | 49/63 X |
| 2,651,082 | 9/1953 | Rylander | 160/90 X |
| 2,812,812 | 11/1957 | Hauck | 49/63 X |
| 2,818,611 | 1/1958 | Andree . | |
| 2,918,706 | 12/1959 | Rust et al. . | |
| 3,080,023 | 3/1963 | Armstrong | 160/90 X |
| 3,168,172 | 2/1965 | Alvarez | 160/91 X |
| 3,295,587 | 1/1967 | Horgan | 160/91 |
| 3,570,182 | 3/1971 | Bakke . | |
| 4,042,004 | 8/1977 | Kwan . | |
| 4,057,937 | 11/1977 | Nakamura | 160/90 X |
| 4,125,141 | 11/1978 | Stillwell . | |
| 4,180,942 | 1/1980 | Saucier | 49/63 X |
| 4,265,052 | 5/1981 | Johnson et al. | 49/63 |
| 4,314,598 | 2/1982 | Roesch | 160/90 |
| 4,331,066 | 5/1982 | Schmidlin . | |
| 4,375,737 | 3/1983 | Buzzella | 160/90 X |
| 4,641,466 | 2/1987 | Raninen et al. . | |
| 4,715,152 | 12/1987 | Tanikawa . | |
| 4,967,507 | 11/1990 | Visnic et al. . | |
| 5,123,212 | 6/1992 | Dallaire et al. . | |

*Primary Examiner*—David M. Purol

*Attorney, Agent, or Firm*—Thomas I. Rozsa; Tony D. Chen

[57] ABSTRACT

The present invention is a novel and unique double window apparatus with insect/solar screens designed for many applications such as residential office buildings and schools. The present invention has three important features which are as follows: first, the double window apparatus has insect/solar screens between the exterior and interior windows; secondly, a pressure chamber is created between the exterior and interior windows and the pressure chamber reduces water entry; and third, the window contains perforated screen tracks covering the fiberglass which serve to reduce the noise transmission inside the building structure. The present invention is utilized as a solar energy admitting device for rejecting or accepting the sun's energy.

28 Claims, 5 Drawing Sheets

DOUBLE WINDOW APPARATUS

BACKGROUND OF THE INVENTION

1. Field of The Invention

The present invention relates to the field of windows. In particular, the present invention relates to a double window apparatus with insect/solar screens between the exterior and interior windows.

2. Description of The Prior Art

In general, there are many different types of windows in today's market. These different types of windows have different features, benefits and different usages. One of the functions of the window is to control the passage of environmental elements and to satisfy the needs of the building or its occupants. For instance, the environmental elements that the window should reject include: wind, water, dirt, noise, vermin, animals, insects, and burglars. The environmental elements that may be allowed in the building structure include: daylight, airflow, heat flow, solar energy, vision, and sounds.

The window may be fixed or operable. Operable types of windows are often referred to as prime windows as distinguished from storm windows, replacement windows, pass-through windows, etc. Windows can be modified to improve certain qualities. For example, a prime window can be fitted with a storm window to improve the window's insulation value or be fitted with a full shade screen on the exterior to lessen the solar heat gain. The storm window is utilized to reduce air infiltration or heat loss, and does not have all of the desirable features of a prime window with respect to structural adequacy etc.

Single window applications have many disadvantages. One disadvantage of the prior art single window applications is that during a rainstorm, a leak can occur because of the difference in air pressure between the outer surfaces and the inner surfaces of the single window. For example, a wind velocity of seventy-seven (77) miles per hour (mph) will create a frontal pressure equal to fifteen (15) pounds per square foot. This pressure can raise a column of water approximately 2.88 inches in a glass tube. This air pressure can drive rain through the joints of the operating parts. To solve this problem, if the same air pressure is maintained simultaneously against the interior surfaces of the exterior window of a double window unit, it can reduce the pressure difference across the operating joints to nearly zero, which greatly reduces the water entry, or the risk of water entry past the exterior window. To create the same desirable condition in a single window application, it would have to pressure equalize the room to the same fifteen (15) pounds per square foot. This is not practical, since this amount of pressure can damage tile interior walls of an average residential structure.

Another disadvantage in a since the window application is that the single thermal window application utilizes dual glazing glass (insulating glass units). The panes enclose a hermetically sealed air space, and are held apart by a spacer around the entire perimeter. These insulating glass units have the advantage over single glass by improved U-value. However, their disadvantage is that the edge seals can fail. The warranty against early failure is a serious business risk to the manufacturer of insulated glass units, and to the window manufacturer who incorporates the insulated glass units into their product.

The following ten (10) prior art patents were uncovered in the pertinent field of the present invention:

1. U.S. Pat. No. 2,81 8,611 issued to Andree on Jan. 7, 1958 for "Prime And Storm Window Combination" (hereafter "the Andree Patent").
2. U.S. Pat. No. 2,918,706 issued to Rust et al. on Dec. 29, 1959 for "Window Frame" (hereafter "the Rust Patent").
3. U.S. Pat. No. 3,570,182 issued to Bakke on Mar. 16, 1971 for "Window Constructions" (hereafter "the Bakke Patent").
4. U.S. Pat. No. 4,042,004 issued to Kwan on Aug. 16, 1977 for "Window Assembly" (hereafter "the Kwan Patent").
5. U.S. Pat. No. 4,125,141 issued to Stillwell on Nov. 14, 1978 for "Self Draining Frame Structure" (hereafter "the Stillwell Patent").
6. U.S. Pat. No. 4,331,066 issued to Schmidlin on May 25, 1982 for "Device For Air Conditioning A Closed Space" (hereafter "the Schmidlin Patent").
7. U.S. Pat. No. 4,641,466 issued to Raninert et al. on Feb. 10, 1987 for "Window" (hereafter "the Raninen Patent").
8. U.S. Pat. No. 4,715,152 issued to Tanikawa on Dec. 29, 1987 for "Watertight Windowsill Construction" (hereafter "the Tanikawa Patent").
9. U.S. Pat. No. 4,967,507 issued to Visnic et al. on Nov. 6, 1990 for "Window Frame" (hereafter "the Visnic Patent").
10. U.S. Pat. No. 5,123,212 issued to Dallaire et al. on Jun. 23, 1992 for "Draining System And Method Of Draining Extruded Window Frame Sills" (hereafter "the Dalaire Patent").

The Andree Patent discloses a prime and storm window combination. It includes a frame with jambs, a jamb header, an exterior casing, an interior casing, and a sill. The window unit has an opening on the exterior surface for installing an insect screen. The double hung glazed panels form the prime and storm windows. Both the prime and storm windows are mounted in frames which are hinged on the side of the frames and swing inwardly. There is no solar screen between the two glazed windows to convert the sun's radiant energy into thermal energy and for accepting or rejecting the sun's radiant energy.

The Rust Patent discloses a window frame. The Rust Patent is a typical single window application with two tracks. The outer track retains a fixed panel in one half of its exterior window area and a half-screen in the other half of the exterior track. The inner glazed panel slides in the inner track. The insect screen covers the area which can be opened for ventilation.

The Bakke Patent discloses a window construction which is a single window application with a frame design which is based on pressure equalization principles. This is not a double window apparatus with insect/solar screens located between the inner and outer windows.

The Kwan Patent discloses a window assembly. The Kwan Patent is a single window application with five tracks. It includes a stationary glass half-panel, a sliding glass half-panel, a half-screen to keep out insects, and two sliding storm panels. The window assembly has no structure or arrangement to create a window assembly for accepting or rejecting solar heat, nor any provision to pressure equalize the chamber between the inner and outer windows, nor any provision to improve the sound reduction between the outdoors and the indoors. The Kwan Patent is specially designed for a recreational vehicle.

The Stillwell Patent discloses a self draining frame structure. The Stillwell Patent is a storm door or storm window, and is arranged on the exterior surface of the storm door or window. The Stillwell Patent has no provisions to control or utilize the solar energy, nor any provision to pressure equalize the space between the interior and exterior windows.

The Schmidlin Patent discloses a device for air conditioning a closed space. The Schmidlin Patent is a complex arrangement comprising double-pane windows with an air outlet channel formed between the inner window and the outer window. A sun drape is arranged in the space opposite the inner window coupled to a mechanical heating/cooling system. The Schmidlin Patent is not a window unit. There are no provisions to open or close the glazed panels. The Schmidlin device requires motors, fans, sensors and duct work.

The Raninen Patent discloses a window. The Raninen Patent is a double window application with a channel for fresh air intake. The glass facing the room has an electrically conductive coating to form a heating element. A jalousie or curtain is arranged in the space between the inner glass which functions as the heating element and the insulating glass element which functions as an outer glass, and at least a part of the fresh air is taken in through the upper part of the window. The Raninen Patent requires electrical energy.

The Tanikawa Patent discloses a water resistant windowsill construction. It includes a fixed single window system with shielded weep holes.

The Visnic Patent discloses a window frame. The Visnic Patent is a single window application with sound absorbing means placed within the frame members. The sound absorbing materials can become watersoaked in the frame, and thereby reduce the effective height: of the sill and reduce the weather resistance of the single window application. The placement of the absorbent material in the sill can badly restrict the sill's ability to freely drain the water and makes the window less practical. The Visnic Patent in not a double window design and has no interior insect/solar screen.

The Dallaire Patent discloses a drainage system and method of draining extruded window frame sills. It includes a drain cap which provides two separate drain paths for the sill. It is also a method of drilling and draining a window sill to prevent the intrusion of wind-blown water.

None of the prior art have combined the concept of having a double window apparatus with insect/solar screens between the interior and exterior windows, and can also accept or reject the sun's energy to heat or cool a building structure or house, while having the function of absorbing air vibrations between the exterior window panels and the interior window panels.

In addition, regulatory organizations currently require that windows meet certain minimum performance standards regarding air infiltration, water penetration, uniform load (structural adequacy), security and operating ease. The California Energy Commission requires that fenestration products be certified to meet U-value (thermal heat transfer) requirements. Future regulations will focus on solar gain, product durability, condensation resistance and sound reduction. The present invention is responsive to all of the above presented and future regulations.

SUMMARY OF THE INVENTION

The present invention is a novel and unique double window apparatus with insect/solar screens designed for many applications such as residential, office buildings and schools. The present invention has new and valuable improvements over existing prior art single window applications. The double window apparatus comprises two prime windows within the same opening, and is intended to achieve certain desirable benefits, which is not achievable with a single window application. The present invention has three important features and they are as follows. First, the double window apparatus has insect/solar screens between the exterior and interior windows. Secondly, a pressure chamber is created between the exterior and interior windows and the pressure chamber reduces water entry. Third, the window contains perforated screen tracks covering the fiberglass which serve to reduce the noise transmission into the building structure.

The present invention is a double window apparatus with insect/solar screens between the exterior and interior windows. The exterior and interior windows have important differences: the interior window is relatively more resistant to air infiltration than the exterior window, and the exterior window is resistant to rain entry, but air entry is intended through the weep holes in the vertical members of the sill. Tile weep holes are not frontally exposed to the outside, but shielded by the horizontal members of the sill to prevent rain from running down over the weep holes, so that only air is allowed to enter. The present invention is manufactured with a common frame with a sloping sill to drain water to the outside. The double window apparatus has a common frame which is an improvement over the two single windows for reasons of installation ease and the reduced risk of leaking between the two separate frames.

It has been discovered, according to the present invention, that by utilizing a double window apparatus, the air pressure acting against the interior surfaces of the exterior window can be reduced to nearly zero across the operating joints, which will greatly reduce the water entry.

It has also been discovered, according to the present invention, that by utilizing an insect/solar shading screen between the double window apparatus, it will provide a solar energy admitting or solar energy rejecting device which allows the occupant to accept or reject the solar energy.

It has additionally been discovered, according to the present invention, that by utilizing a common frame for the double window apparatus, it will reduce the risk of window leaks.

It has further been discovered, according to the present invention, that the screen track can be utilized to retain the insect/solar screens to cover the acoustic absorbent material, and to capture and drain water infiltration to the outside.

It has additionally been discovered, according to the present invention, that the screen track perimeter can function as a sound reduction system, the perimeter elements can be perforated to allow noise to enter the acoustic absorbent material, and the insulation dampens the vibration of the window frame and the screen track.

It has further been discovered, according to the present invention, that by utilizing the airspace between the exterior and interior windows, a pressure equalized air chamber opens to the outside atmosphere through rain shielded weep holes. The interior window panels are more airtight than the exterior window panels. The air pressure therefore reduces water entry and if any water penetrates past the exterior window panels, it will be captured by the screen track and absorbed by the fiberglass insulation, for later drainage to the outside.

It is therefore an object of the present invention to provide a double window apparatus, so that it can reduce the air pressure across the operating joints to nearly zero and reduce the water entry.

It is also an object of the present invention to provide an insect/solar screen between the double window apparatus, so that it can be a solar collector for accepting or rejecting the sun's energy, and also keep out insects.

It is an additional object of the present invention to provide a common frame, so that it can reduce the risk of water leaks.

It is a further object of the present invention to provide a screen track so that it can retain the insect/solar screens, to cover the acoustic absorbent material, and to capture and drain water infiltration to the outside. The screen track perimeter can also function as a sound reduction system. The perimeter elements are perforated to allow noise to enter the acoustic absorbent material, and the insulation dampens the vibration of the window frame and the screen track.

It is an additional object of the present invention to provide an airspace between the exterior and interior windows, so that a pressure equalized air chamber opens to the outside atmosphere through rain shielded weep holes. The interior window panels are more airtight than the exterior window panels. The air pressure therefore reduces water entry and if any water penetrates past the exterior window panels, it can be captured by the screen track and absorbed by the fiberglass insulation.

In the preferred embodiment of the present invention, a single glazed panel is utilized rather than the dual glazed (insulated glass) panel. The single glazed panel is preferred over a dual glazed panel on a life cost basis, since dual glazed panels are subject to failure of their edge seals. A low U-value is desirable for energy conservation. Although this design is suitable for windows made of wood or plastic, a thermal window manufactured from aluminum extrusions may have important cost benefits in comparison to wood or plastic.

The insect/solar screen fabric materials can be designed or selected to satisfy different market requirements. For residential applications, the preferred embodiment of the insect/solar screen is the PHIFER SUNSCREEN-R, U.S. Pat. No. 4,002,188. For school or office building applications, the preferred embodiment of the insect/solar screen is the PHIFER SHADESCREEN-R which is a louvered aluminum screen. It is desirable that sunlight or the sky's reflected light be redirected at the window plane to the ceiling of the rooms so that it improves the daylight brightness ratio and decreases the need for artificial lighting, reduces glare, and reduces cooling requirements.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1*a* through 1*h*, there are illustrated the unique features of the present invention double window apparatus 2 which will be described in detail later. In the preferred embodiment, the present invention can be utilized with two types of window arrangements which are the horizontal sliding arrangement or the vertical sliding arrangement. It will be appreciated that the present invention is not limited to these two arrangements illustrated in FIGS. 2 and 3, It is emphasized that while the horizontal and vertical arrangements are the preferred embodiments, it is also within the spirit and scope of the present invention to have a multiplicity of arrangements utilizing the double window apparatus.

Figure 2:
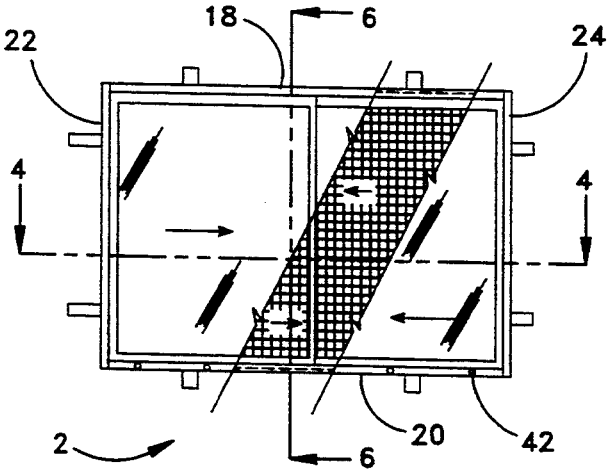
FIG. 2 is a front view of the present invention double window apparatus in the horizontal sliding position.
Figure 4:
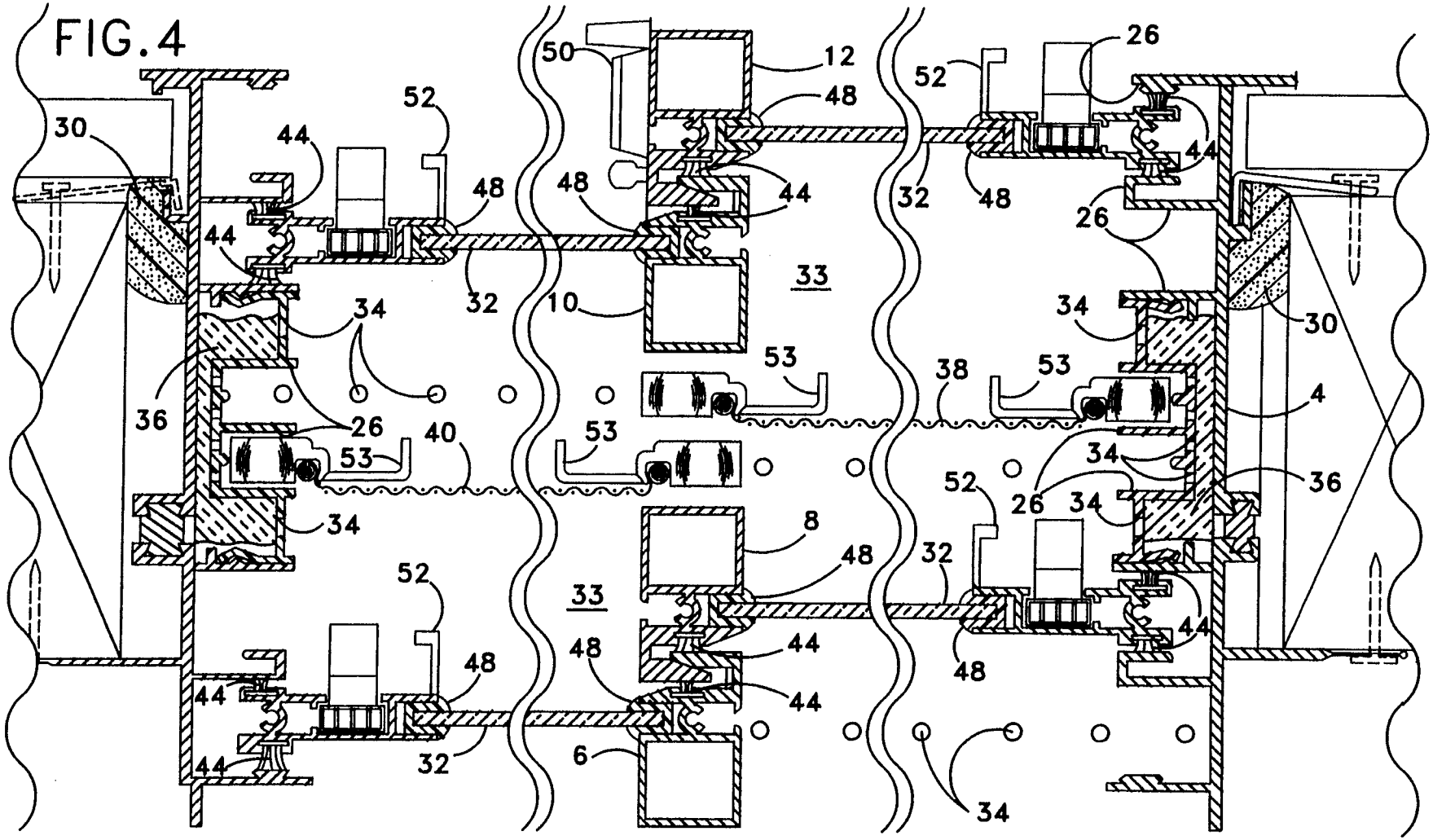
FIG. 4 is a cross-sectional view taken along line 4—4 of FIG. 2.
Figure 6:
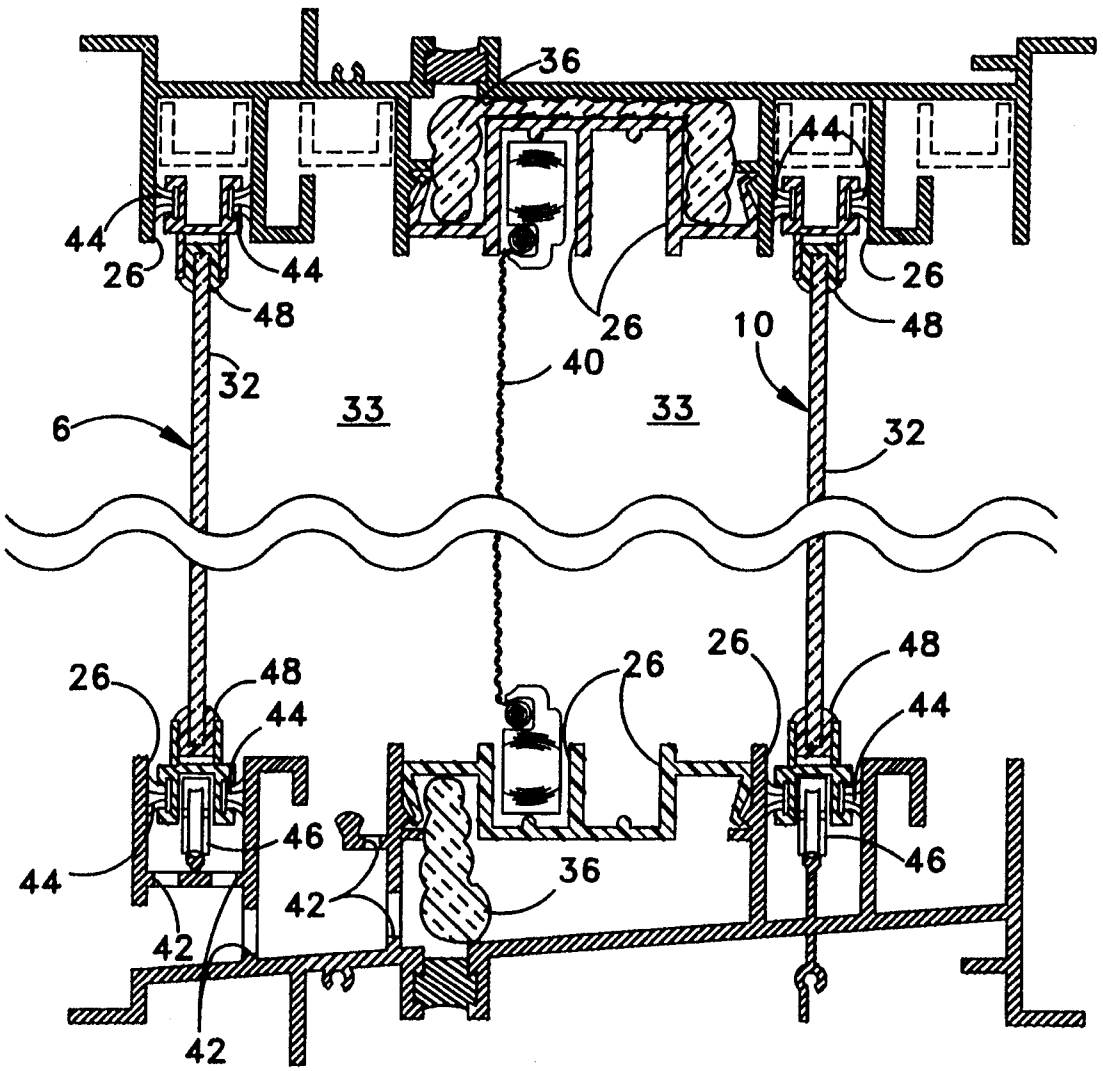
FIG. 6 is a cross-sectional view taken along line 6—6 of FIG. 2.

Referring to FIGS. 2, 4 and 6, there is shown the preferred embodiment of the present invention double window apparatus 2 in the horizontal sliding arrangement. The terms "exterior" and "interior" as used herein, refer to the exterior of tile building structure and the interior of the building structure.

The double window apparatus 2 comprises a generally rectangular shaped common frame 4 with a sloping sill for draining water to the exterior of the building structure. The common frame 4 is mounted into a wall opening of the building structure, where urethane foam air seals 30 are inserted between the common frame 4 and the studs, as shown in the cross-sectional view of FIG. 4. It will be appreciated that the double window apparatus 2 is not limited to this one type of construction described above. It is also within the spirit and scope of the present invention to have the double window apparatus 2 utilized with different types of construction.

The present invention provides an improvement over the two single windows application because of easy installation and reduction of the risk of leakage between the two separate frames. The common frame 4 includes a top frame member 18, a bottom frame member 20 and two opposite lateral frame members 22, 24 such that the frame members are joined together end-to-end in any appropriate manner, where the common frame 4 forms an exterior frame section, a middle frame section and an interior frame section. Each frame section comprises a pair of transverse parallel elongated tracks 26 which are located on each frame section of the common frame 4. The common frame 4 can be of a size and shape to accommodate any typical wall aperture for windows.

The present invention includes two active operable exterior window panels 6 and 8, and two active operable interior window panels 10 and 12. The two active operable exterior window panels 6 and 8 are positioned in the pair of transverse parallel elongated tracks 26 of the exterior frame section at opposite locations, where both of the active operable exterior window panels 6 and 8 can be opened or closed horizontally. The two active operable interior window panels 10 and 12 are positioned in the pair of transverse parallel elongated tracks 26 of the interior frame section at opposite locations, where both of the active operable interior window panels 10 and 12 can be opened or closed horizontally. Each window panel has a single glazing sheet of glass 32 which has important cost advantages, greater durability, and a lower lifetime cost based on the use of the single glazing sheet of glass 32. Each single glazing glass 32 is mounted in each window panel and is sealed by glazing gaskets or other suitable means 48 for keeping air and water from entering into the building structure. Tile glazing gaskets 48 are preferably made out of vinyl material or any suitable material. Each window panel also has a roller assembly 46 (see FIG. 6) which allows all of the active operable window panels 6, 8, 10 and 12 to slide back and forth. Weatherstrippings 44 are used to cover the joint between the window sash and the jamb. A lock 50 and a finger pull handle 52 are used for locking and opening all of the active operable exterior and interior window panels 6, 8, 10 and 12.

A first slidable insect/solar screen 38 and a second slidable insect/solar screen 40 are positioned in the pair of transverse parallel elongated tracks 26 of the middle frame section at opposite locations, where each of the slidable insect/solar screens can be slid horizontally by pulling a finger handle 53. The middle frame section has a hollow chamber located all around the middle frame section with a multiplicity of perforations 34. The hollow chamber is filled with a glass wool material or acoustic absorbent material 36 for absorbing sound waves and preventing the flow of foreign material therethrough. The two slidable insect/solar screens 38, 40 are made out of a fabric of a small mesh size. The fabric is intended to block out approximately 70% to 80% of the sun's heat and glare, as well as to keep out insects.

The pair of transverse parallel elongated tracks 26 of the middle frame section can be made from several materials. By way of example, the pair of transverse parallel elongated tracks 26 is preferably constructed of polyvinyl chloride (PVC) plastic material. It will be appreciated that the pair of transverse parallel elongated tracks 26 is not limited to the PVC plastic material. It is emphasized that while the PVC plastic material is preferred, it is also within the spirit and scope of the present invention to use any suitable material.

The insect/solar screen fabric material can be designed or selected to satisfy different market requirements. For residential applications, the preferred embodiment of the insect/solar screen is the PHIFER SUNSCREEN-R, U.S. Pat. No. 4,002,188 or any other similar material. For school or office building applications, the preferred embodiment of the insect/solar screen is the PHIFER SHADESCREEN-R which is a louvered aluminum screen or any other similar material. It is desirable that sunlight or the sky's reflected light be redirected at the window plane to the ceiling of the room, so that it improves the daylight brightness ratio and decreases the need for artificial lighting, reduces glare, and reduces cooling requirements.

The use of an insect/solar screen in the present invention permits the use of clear glass rather than coated glass for reducing the heat gain and for an important cost advantage. The insect/solar screens 38 and 40 reduce the heat loss at night or for windows not in sunlight, and will contribute to savings in heating fuel.

When the active operable exterior window panels 6 and 8 and the active operable interior window panels 10 and 12 are mounted, the airspace between the exterior and interior window panels is a pressure equalized air chamber 33, open to the outside atmosphere through rain shielded weep holes 42, as shown in FIGS. 2 and 6. The active operable interior window panels 10 and 12 are more airtight than the active operable exterior window panels 6 and 8. This air pressure therefore reduces water entry. In addition, any water penetration past the active operable exterior window panels 6 and 8 will be captured by the pair of transverse parallel elongated tracks 26 of the middle frame section and will be absorbed by the fiberglass 36 for later evaporation to the outside. The fiberglass 36 at the sill prevents wind blown water entry through the multiplicity of weep holes 42.

Figure 1A:
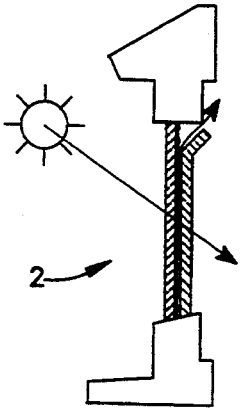
FIG. 1*a* is an illustration of the present invention showing the controlling of the solar energy admitted to a building structure.
Figure 1B:
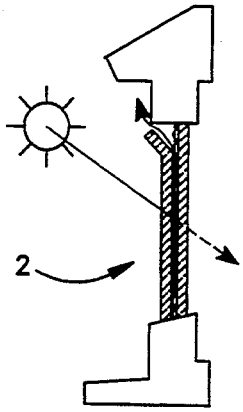
FIG. 1*b* is an illustration of the present invention showing the controlling of the solar energy rejected from the building structure.
Figure 1C:
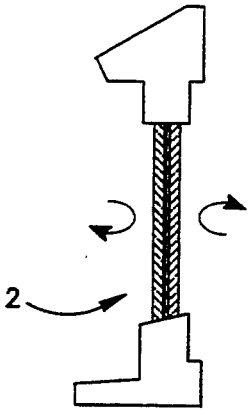
FIG. 1*c* is an illustration of the thermal values of the present invention.
Figure 1D:
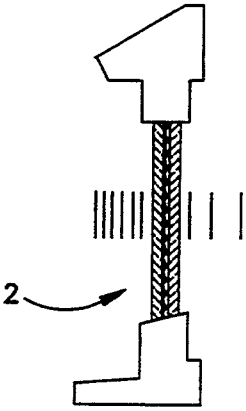
FIG. 1*d* is an illustration of the sound reduction of the present invention.
Figure 1E:
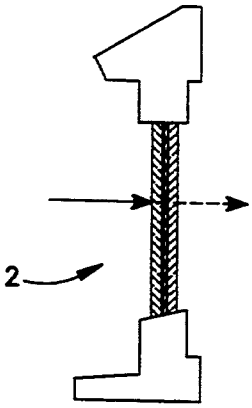
FIG. 1*e* is an illustration of the low air infiltration of the present invention.

The active operable exterior window panels 6 and 8 and the active operable interior window panels 10 and 12 have important differences such that the interior window panels 10 and 12 are relatively more resistant to air infiltration than the exterior window panels 6 and 8, as illustrated in FIG. 1*e*. The exterior window panels 6 and 8 are resistant to rain entry but air entry is intended through weep holes 42 in the vertical members of the sill. The weep holes 42 are not frontally exposed to the outside, but are shielded by horizontal members of the sill, to prevent rain from running down over the weep holes 42, so only air is allowed to enter.

In operation, when both of the active operable interior window panels 10 and 12 are opened and both of the active operable exterior window panels 6 and 8 are closed, the heat from the solar energy absorbed by the insect/solar screens 38 and 40 can transfer to the inside of the building structure. When both of the active operable interior window panels 10 and 12 are closed and both of the active operable exterior window panels 6 and 8 are opened, the heat from the solar energy absorbed by the insect/solar screens 38 and 40 can dissipate to the outside of the building structure. When all of the active operable exterior and interior window panels 6, 8, 10 and 12 are opened, fresh air can ventilate inside the building, and when all of the active operable exterior and interior window panels 6, 8, 10 and 12 are closed, the inside of the building structure is isolated from the outside of the building structure and any audible vibrations between the active operable exterior and interior window panels 6 and 8, 10 and 12 respectively are reduced and partially absorbed by the glass wool material 36.

It will be appreciated that the present invention is not limited to all active operable window panels. It is emphasized that while all of the window panels are all operable in the preferred embodiment, it is also within the spirit and scope of the present invention to manufacture at least one inactive exterior window panel, at least one active operable exterior window panel, and at least one inactive interior window panel and at least one active operable interior window panel. In this alternative embodiment, by way of example, exterior window panel 6 could be an inactive window panel and exterior window panel 8 could be an active operable window panel. Similarly, interior window panel 10 could be an inactive window panel and interior window panel 12 could be an operable window panel. The invention works the same way and the principles discussed also apply in this alternative embodiment.

Figure 3:
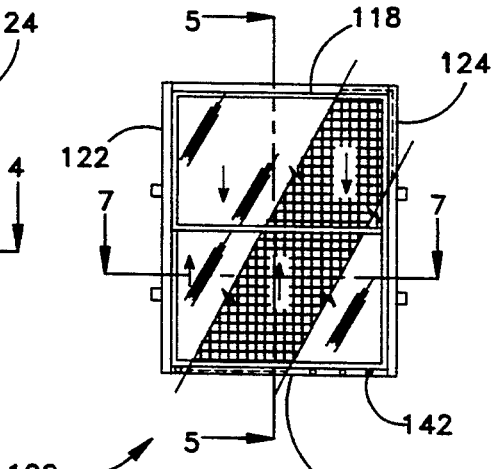
FIG. 3 is a front view of the present invention double window apparatus in the vertical sliding position.
Figure 5:
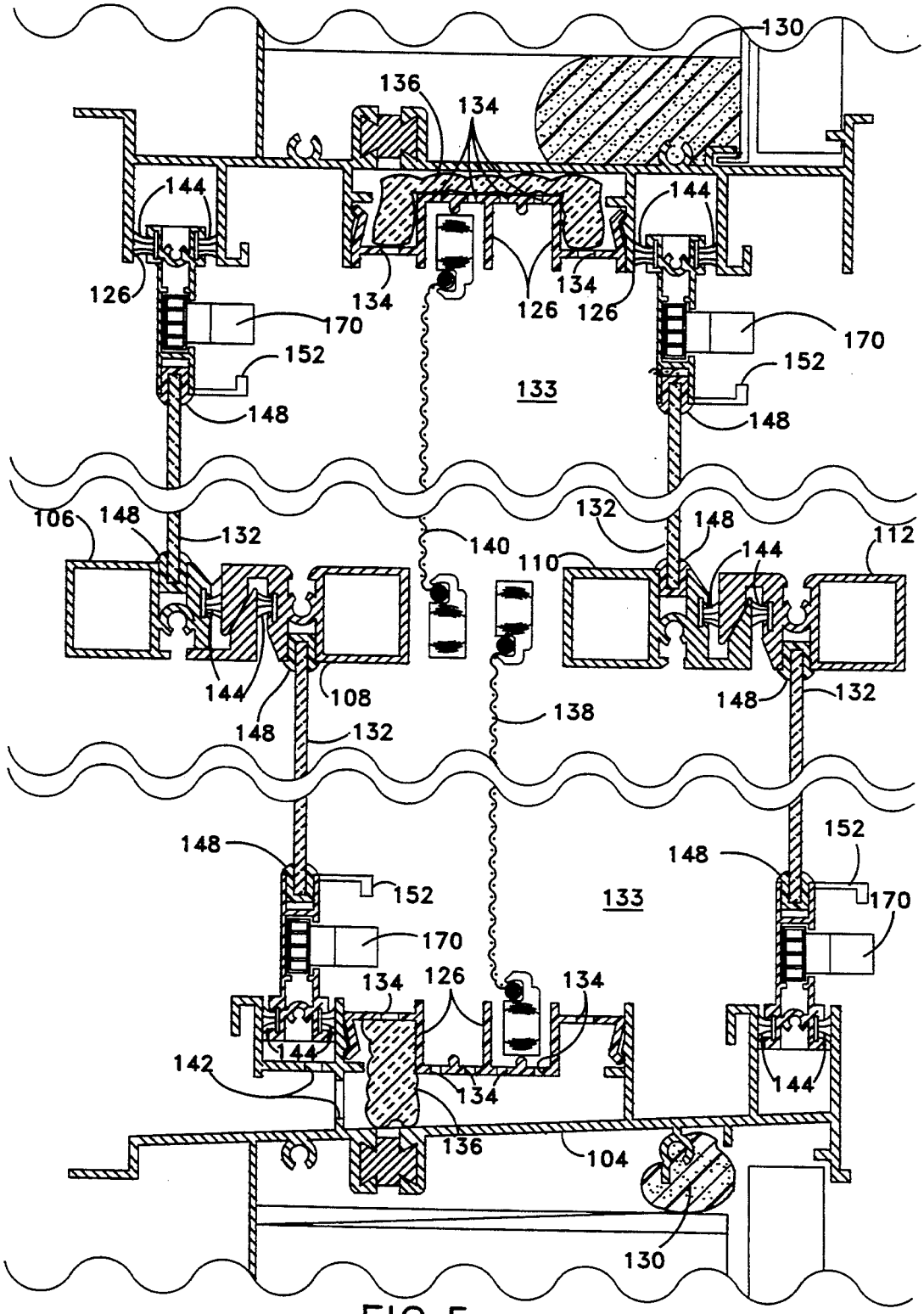
FIG. 5 is a cross-sectional view taken along line 5—5 of FIG. 3.
Figure 7:
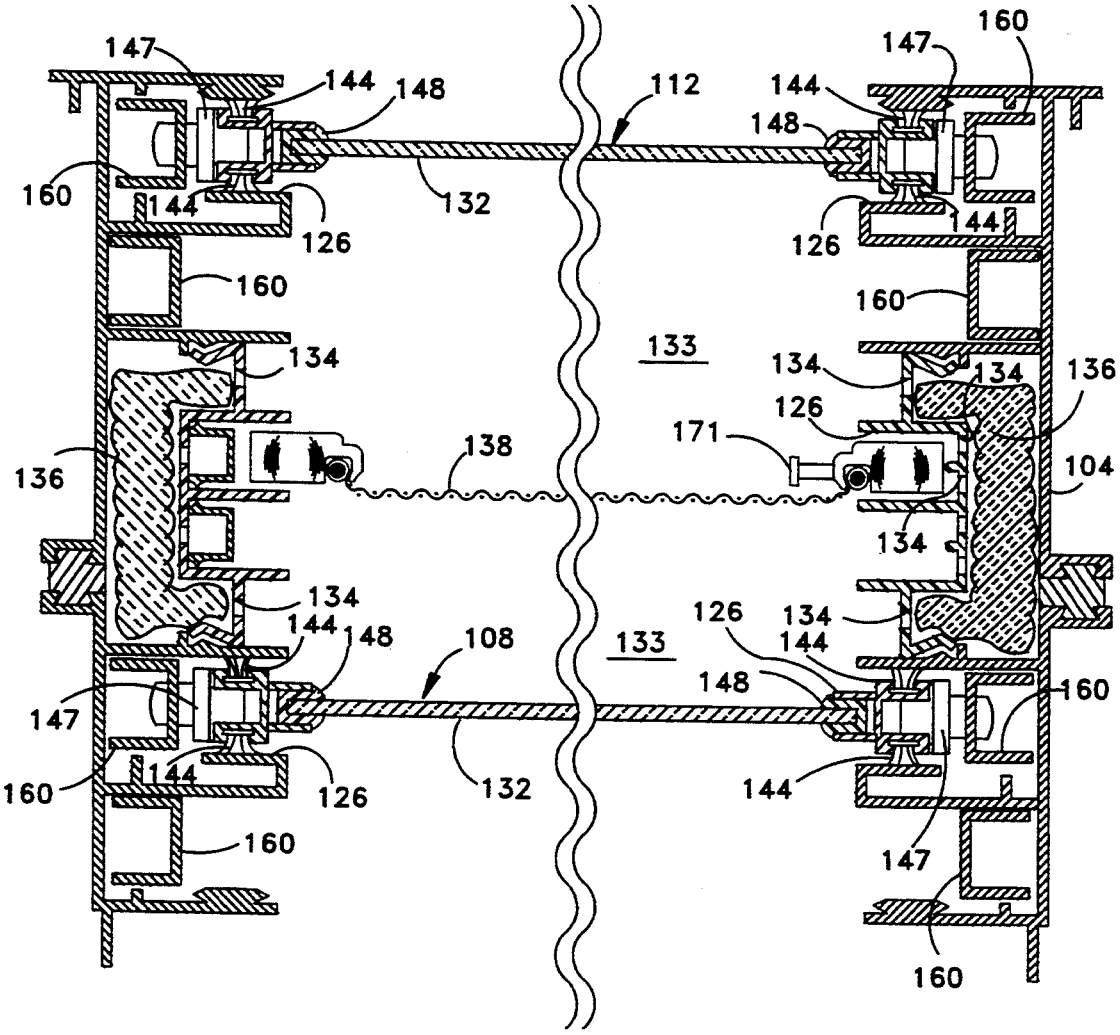
FIG. 7 is a cross-sectional view taken along line 7—7 of FIG. 3.

Referring to FIGS. 3, 5 and 7, there is shown another preferred embodiment of the present invention double window apparatus 102 in the vertical sliding arrangement. Since it assembles and functions the same as previously described above except that the two active operable exterior window panels and the two active operable interior window panels 106, 108, 110 and 112 respectively can be opened or closed vertically, the parts are numbered correspondingly with 100 added to each number.

The double window apparatus 102 comprises a generally rectangular shaped common frame 104 with a sloping sill for draining water to the exterior of the building structure. The common frame 104 is mounted into a wall opening of the building structure, where urethane foam air seals 130 are inserted between the common frame 104 and the studs, as shown in the cross-sectional view of FIG. 5. It will be appreciated that the double window apparatus 102 is not limited to this one type of construction described above. It is also within the spirit and scope of the present invention to have the double window apparatus 102 utilized with different types of construction.

The present invention provides an improvement over the two single windows application because of easy installation and reduction of the risk of leakage between the two separate frames. The common frame 104 includes a top frame member 118, a bottom frame member 120 and two opposite lateral frame members 122 and 124 such that the frame members are joined together end-to-end in any appropriate manner, where the common frame 104 forms an exterior frame section, a middle frame section and an interior frame section. Each frame section comprises a pair of vertical parallel elongated tracks 126 which are located on each frame section of the common frame 104. Each vertical parallel elongated track 126 of the exterior and interior frame sections further includes a jamb guide channel 160 with latch holes (not shown) which are equally spaced apart. The common frame 104 can be of a size and shape to accommodate any typical wall aperture for windows.

The two active operable exterior window panels 106 and 108 are positioned in the pair of vertical parallel elongated tracks 126 of the exterior frame section at opposite locations, where both of the active operable exterior window panels 106 and 108 can be opened or closed vertically and held in position by sliding bolts 170 which are inserted into the latch holes on the jamb guide channels 160. The two active operable interior window panels 110 and 112 are positioned in the pair of vertical parallel elongated tracks 126 of the interior frame section at opposite locations, where both of the active operable interior window panels 110 and 112 can be opened or closed vertically. Each window panel has a single glazing sheet of glass 132 which has important cost advantages, greater durability, and a lower lifetime cost based on the use of the single glazing sheet of glass 132. Each single glazing glass 132 is mounted in each window panel and is sealed by glazing gaskets or other suitable means 148 for keeping air and water from entering into the building structure. The glazing gaskets 148 are preferably made out of vinyl material or any suitable material. Each window panel also has a glide 147 (see FIG. 7) which allows all of the window panels 106, 108, 110 and 112 to slide up and down. Weatherstrippings 144 are used to cover the joint between the window sash and the jamb. The slide bolts 170 and finger pull handles 152 are used for locking and opening all of the window panels 106, 108, 110 and 112.

A first slidable insect/solar screen 138 and a second slidable insect/solar screen 140 are positioned in the pair of vertical parallel elongated tracks 126 of the middle frame section at opposite locations, where the slidable insect/solar screens can be slid up and down vertically by pulling a plunger bolt 171 (see FIG. 7). The middle frame section has a hollow chamber located all around the middle frame section with a multiplicity of perforations 134. The hollow chamber is filled with a glass wool material or fiberglass 136 for absorbing sound waves and preventing the flow of foreign material therethrough. The two slidable insect/solar screens 138, 140 are made out of a fabric of a small mesh size. The fabric is intended to block out approximately 70% to 80% of the sun's heat and glare, as well as to keep out insects.

The pair of vertical parallel elongated tracks 126 of the middle frame section can be made from several materials. By way of example, the pair of vertical parallel elongated tracks 126 is preferably constructed of PVC plastic material. It will be appreciated that the pair of vertical parallel elongated tracks 126 is not limited to the PVC plastic material. It is emphasized that while the PVC plastic material is preferred, it is also within the spirit and scope of the present invention to use any suitable material.

When the active operable exterior window panels 106 and 108 and the active operable interior window panels 110 and 112 are mounted, the airspace between the exterior and interior window panels is a pressure equalized air chamber 133, open to the outside atmosphere through rain shielded weep holes 142. The active operable interior window panels 110 and 112 are more airtight than the active operable exterior window panels 106 and 108. This air pressure therefore reduces water entry. In addition, any water penetration past the active operable exterior window panels 106 and 108 will be captured by the pair of vertical parallel elongated tracks 126 of the middle frame section and will be absorbed by the fiberglass 136 for later evaporation to the outside. The fiberglass 136 at the sill prevents wind blown water entry through the multiplicity of weep holes 142.

It will be appreciated that the present invention is not limited to all active operable window panels. It is emphasized that while all of the window panels are all operable in the preferred embodiment, it is also within the spirit and scope of the present invention to manufacture at least one inactive exterior window panel, at least one active operable exterior window panel, and at least one inactive interior window panel and at least one active operable interior window panel. In this alternative embodiment, by way of example, exterior window panel 106 could be an inactive window panel and exterior window panel 108 could be an active operable window panel. Similarly, interior window panel 110 could be an inactive window panel and interior window panel 112 could be an operable window panel. The invention works the same way and the principles discussed also apply in this alternative embodiment.

Figure 1F:
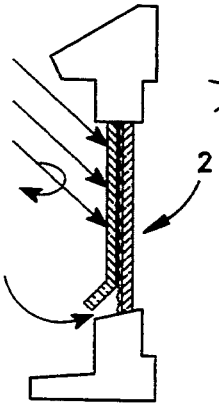
FIG. 1*f* is an illustration of a high rise market application of the present invention.
Figure 1G:
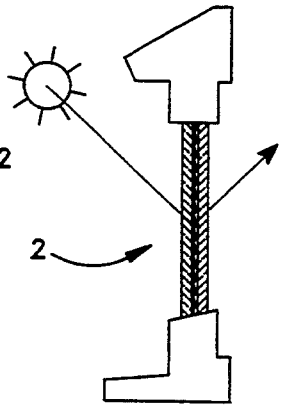
FIG. 1*g* is an illustration of the improved daylight brightness ratios of the present invention.
Figure 1H:
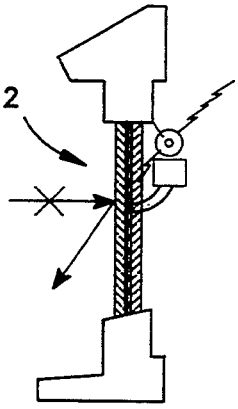
FIG. 1*h* is an illustration of the burglar resistant options available in the present invention double window apparatus.

The present invention has many advantageous features which are illustrated in the following figures. FIG. 1*a* illustrates the present invention double window apparatus which can control the solar energy admitted to the building structure. FIG. 1*b* illustrates how the double window apparatus 2 can reject the solar energy from the building structure. FIG. 1*c* illustrates the thermal values of the present invention double window apparatus 2. FIG. 1*d* illustrates the present invention double window apparatus 2 which can reduce the noise from the outside of the building structure. FIG. 1*e* illustrates the low air infiltration of the double window apparatus 2 to the building structure. FIG. 1*f* illustrates the double window apparatus 2 utilize in a high rise market application. FIG. 1*g* illustrates the improved daylight brightness ratios of the double window apparatus 2. FIG. 1*h* illustrates the present invention double window apparatus 2 which can be utilized with a burglar device.

Defined in detail, the present invention is a double horizontal window apparatus for a building structure, comprising: (a) a generally rectangular shaped common frame having a top frame member, a bottom frame member and two opposite lateral frame members, the common frame including an exterior frame section, a middle frame section and an interior frame section, each having a pair of transverse parallel elongated tracks; (b) two active exterior window panels positioned in said pair of transverse parallel elongated tracks of said exterior frame section at opposite locations, where the two active exterior window panels can be opened or closed horizontally; (c) two active interior window panels positioned in said pair of transverse parallel elongated tracks of said interior frame section at opposite locations, where the two active interior window panels can be opened or closed horizontally; (d) said two active exterior window panels and said two active interior window panels define an air pressure chamber therebetween; (e) a first slidable insect/solar screen and a second slidable insect/solar screen positioned in said pair of transverse parallel elongated tracks of said middle frame section at opposite locations and located between said two active exterior window panels and said two active interior window panels, where the slidable insect/solar screens can be slid horizontally; (f) said middle frame section having a hollow chamber located all around said middle frame section with a multiplicity of perforations; (g) a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said two active exterior window panels; and (h) a glass wool material inserted in said hollow chamber of said middle frame section for absorbing sound waves and preventing the flow of foreign material therethrough; (i) whereby when said two active interior window panels are opened and said two active exterior window panels are closed, the heat from the solar energy absorbed by said insect/solar screens can transfer inside said building structure, when said two active interior window panels are closed and said two active exterior window panels are opened, the heat from the solar energy absorbed by said insect/solar screens can dissipate outside of said building structure, when said two active interior window panels and said two active exterior window panels are opened, fresh air can ventilate said building structure, and when said two active interior window panels and said two active exterior window panels are closed, the inside of said building structure is isolated from the outside of said building structure, and any audible vibrations between said two active interior window panels and said two active exterior window panels are partially absorbed by said glass wool material.

Also defined in detail, the present invention is a double vertical window apparatus for a building structure, comprising: (a) a generally rectangular shaped common frame having a top frame member, a bottom frame member and two opposite lateral frame members, the common frame including an exterior frame section, a middle frame section and an interior frame section, each having a pair of vertical parallel elongated tracks; (b) two active exterior window panels positioned in said pair of vertical parallel elongated tracks of said exterior frame section at opposite locations, where the two active exterior window panels can be opened or closed vertically; (c) two active interior window panels positioned in said pair of vertical parallel elongated tracks of said interior frame section at opposite locations, where the two active interior window panels can be opened or closed vertically; (d) said two active exterior window panels and said two active interior window panels define an air pressure chamber therebetween; (e) a first slidable insect/solar screen and a second slidable insect/solar screen positioned in said pair of vertical parallel elongated tracks of said middle frame section and located between said two active exterior window panels and said two active interior window panels, where the slidable insect/solar screens can be slid vertically; (f) said middle frame section having a hollow chamber located all around said middle frame section with a multiplicity of perforations; (g) a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said two active exterior window panels; and (h) a glass wool material inserted in said hollow chamber of said middle frame section for absorbing sound waves and preventing the flow of foreign material therethrough; (i) whereby when said two active interior window panels are opened and said two active exterior window panels are closed, the heat from the solar energy absorbed by said insect/solar screens can transfer inside said building structure, when said two active interior window panels are closed, and said two active exterior window panels are opened, the heat from the solar energy absorbed by said insect/solar screens can dissipate to outside of said building structure, when said two active interior window panels and said two active exterior window panels are opened, fresh air can ventilate said building structure, said two active interior window panels and said two active exterior window panels are closed, the inside of said building structure is isolated from the outside of said building structure, and any audible vibrations between said two active interior window panels and said two active exterior window panels are partially absorbed by said glass wool material.

Defined broadly, the present invention is a double window apparatus, comprising: (a) a frame having a top member, a bottom member and two side members, the frame including an exterior section, a middle section and an interior section; (b) at least one exterior window positioned in said exterior section of said frame, where the at least one exterior window can be opened or closed; (c) at least one interior window position in said interior section of said frame, where the at least one interior window can be opened or closed; (d) said at least one exterior window and said at least one interior window define a pressure chamber therebetween; (e) at least one screen positioned in said middle section of said frame, where the at least one screen is located between said at least one exterior window and said at least one interior window; (f) said middle section having a hollow chamber located all around said frame with a multiplicity of perforations; (g) means for allowing air to flow through to said pressure chamber, said pressure chamber opens to the outside atmosphere, where said pressure chamber reduces water entry through said at least one exterior window; and (h) an acoustic absorbent material inserted in said hollow chamber of said middle section for absorbing sound waves and preventing the flow of foreign material from said at least one exterior window to said at least one interior window; (i) whereby when said at least one interior window is opened and said at least one exterior window is closed, the heat from the solar energy absorbed by at least one screen can transfer inside said structure, when said at least one interior window is closed and said at least one exterior window is opened, the heat from the solar energy absorbed by said at least one screen can dissipate to outside of said structure, when said at least one interior and exterior windows are opened, fresh air can ventilate said structure, and when said at least one interior and exterior windows are closed, the inside of said structure is isolated from the outside of said structure, and any audible vibrations between said at least one interior and exterior windows are partially absorbed by said acoustic absorbent material.

Defined alternatively in detail, the present invention is a double horizontal window apparatus for a building structure, comprising: (a) a generally rectangular common frame having a top frame member, a bottom frame member and two opposite lateral frame members, the common frame including an exterior frame section, a middle frame section and an interior frame section, each having a pair of parallel elongated tracks; (b) an inactive exterior window panel and an active exterior window panel positioned in said pair of parallel elongated tracks of said exterior frame section, where the active exterior window panel can be opened or closed horizontally; (c) an inactive interior window panel and an active interior window panel positioned in said pair of parallel elongated tracks of said interior frame section, where the active interior window panel can be opened or closed horizontally; (d) said exterior window panels and said interior window panels define an air pressure chamber therebetween; (e) a first slidable insect/solar screen and a second slidable insect/solar screen positioned in said pair of parallel elongated tracks of said middle frame section and located between said exterior window panels and said interior window panels, where the slidable insect/solar screens can be slid horizontally; (f) said middle frame section having a hollow chamber located all around said middle frame section with a multiplicity of perforations; (g) a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said exterior window panels; and (h) a glass wool material inserted in said hollow chamber of said middle frame section for absorbing sound waves and preventing the flow of foreign material therethrough; (i) whereby when said active interior window panel is opened and said active exterior window panel is closed, the heat from the solar energy absorbed by said insect/solar screens can transfer inside said building structure, when said active interior window panel is closed and said active exterior window panel is opened, the heat from the solar energy absorbed by said insect/solar screens can dissipate outside of said building structure, when said active interior and exterior windows are both opened, fresh air can ventilate said building structure, and when said active interior and exterior windows are both closed, the inside of said building structure is isolated from the outside of said building structure, and any audible vibrations between said interior and exterior window panels are partially absorbed by said glass wool material.

Also defined alternatively in detail, the present invention is a double vertical window apparatus for a building structure, comprising: (a) a generally rectangular common frame having a top frame member, a bottom frame member and two opposite lateral frame members, the common frame including an exterior frame section, a middle frame section and an interior frame section, each having a pair of parallel elongated tracks; (b) an inactive exterior window panel and an active exterior window panel positioned in said pair of parallel elongated tracks of said exterior frame section, where the active exterior window panel can be opened or closed vertically; (c) an inactive interior window panel and an active interior window panel positioned in said pair of parallel elongated tracks of said interior frame section, where the active interior window panel can be opened or closed vertically; (d) said exterior window panels and said interior window panels define an air pressure chamber therebetween; (e) a first slidable insect/solar screen and a second slidable insect/solar screen positioned in said pair of parallel elongated tracks of said middle frame section and located between said exterior window panels and said interior window panels, where the slidable insect/solar screens can be slid vertically; (f) said middle frame section having a hollow chamber located all around said middle frame section with a multiplicity of perforations; (g) a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said exterior window panels; and (h) a glass wool material inserted in said hollow chamber of said middle frame section for absorbing sound waves and preventing the flow of foreign material therethrough; (i) whereby when said active interior window panel is opened and said active exterior window panel is closed, the heat from the solar energy absorbed by said insect/solar screens can transfer inside said building structure, when said active interior window panel is closed, and said active exterior window panel is opened, the heat from the solar energy absorbed by said insect/solar screens can dissipate to outside of said building structure, when said active interior and exterior windows are both opened, fresh air can ventilate said building structure, said active interior and exterior windows are both closed, the inside of said building structure is isolated from the outside of said building structure, and any audible vibrations between said interior and exterior window panels are partially absorbed by said glass wool material.

Further defined more broadly, the present invention is a double window apparatus, comprising (a) a common frame for mounting an exterior window, an interior window and a screen therebetween, both the exterior and the interior windows being individually openable or closable; (b) said frame having means for equalizing the air pressure between said exterior and interior windows to that of the outside atmosphere, to reduce water leakage through said exterior window; and (c) said frame further having means for absorbing acoustic vibration to reduce noise transmitted through said double window apparatus.

Alternatively defined more broadly, the present invention is a double window apparatus, comprising (a) a common frame for mounting an exterior window, an interior window and a screen therebetween, both the exterior and the interior windows being individually openable or closable; and (b) said frame having means for equalizing the air pressure between said exterior and interior windows to that of the outside atmosphere, to reduce water leakage through said exterior window.

Also alternatively defined more broadly, the present invention is a double window apparatus, comprising (a) a common frame for mounting an exterior window, an interior window and a screen therebetween, both the exterior and the interior windows being individually openable or closable; and (b) said frame further having means for absorbing acoustic vibration to reduce noise transmitted through said double window apparatus.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A double horizontal window apparatus for a building structure, comprising:

a. a generally rectangular shaped common frame having a top frame member, a bottom frame member and two opposite lateral frame members, the common frame including an exterior frame section, a middle frame section and an interior frame section, each having a pair of transverse parallel elongated tracks;

b. two active exterior window panels positioned in said pair of transverse parallel elongated tracks of said exterior frame section at opposite locations, where the two active exterior window panels can be opened or closed horizontally;

c. two active interior window panels positioned in said pair of transverse parallel elongated tracks of said interior frame section at opposite locations, where the two active interior window panels can be opened or closed horizontally;

d. said two active exterior window panels and said two active interior window panels define an air pressure chamber therebetween;

e. a first slidable insect/solar screen and a second slidable insect/solar screen positioned in said pair of transverse parallel elongated tracks of said middle frame section at opposite locations and located between said two active exterior window panels and said two active interior window panels, where the slidable insect/solar screens can be slid horizontally;

f. said middle frame section having a hollow chamber located all around said middle frame section with a multiplicity of perforations;

g. a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said two active exterior window panels; and h. a glass wool material inserted in said hollow chamber of said middle frame section for absorbing sound waves and preventing the flow of foreign material therethrough;

i. whereby when said two active interior window panels are opened and said two active exterior window panels are closed, the heat from the solar energy absorbed by said insect/solar screens can transfer inside said building structure, when said two active interior window panels are closed and said two active exterior window panels are opened, the heat from the solar energy absorbed by said insect/solar screens can dissipate outside of said building structure, when said two active interior window panels and said two active exterior window panels are opened, fresh air can ventilate said building structure, and when said two active interior window panels and said two active exterior window panels are closed, the inside of said building structure is isolated from the outside of said building structure, and any audible vibrations between said two active interior window panels and said two active exterior window panels are partially absorbed by said glass wool material.

2. The invention as defined in claim 1 further comprising means for mounting said common frame to a wall opening of said building structure.

3. The invention as defined in claim 1 further comprising roller assemblies attached to said two active exterior window panels and said two active interior window panels for allowing said two active exterior window panels and said two active interior window panels to slide horizontally back and forth.

4. The invention as defined in claim 1 further comprising glazing gaskets located on said two active exterior window panels and said two active interior window panels at opposite locations for sealing said window panels.

5. The invention as defined in claim 1 further comprising a lock and a finger pull handle located on said two active exterior window panels and said two active interior window panels for locking and opening said two active exterior window panels and said two active interior window panels.

6. The invention as defined in claim 1 wherein said two active exterior window panels and said two active interior windows panels are single glazing glasses.

7. The invention as defined in claim 1 wherein said multiplicity of weep holes are shielded by a horizontal member of a sill to prevent rain from running down over said multiplicity of weep holes.

8. The invention as defined in claim 1 wherein said pair of transverse parallel elongated tracks of said middle frame section are made of PVC plastic.

9. A double vertical window apparatus for a building structure, comprising:

a. a generally rectangular shaped common frame having a top frame member, a bottom frame member and two opposite lateral frame members, the common frame including an exterior frame section, a middle frame section and an interior frame section, each having a pair of vertical parallel elongated tracks;

b. two active exterior window panels positioned in said pair of vertical parallel elongated tracks of said exterior frame section at opposite locations, where the two active exterior window panels can be opened or closed vertically;

c. two active interior window panels positioned in said pair of vertical parallel elongated tracks of said interior frame section at opposite locations, where the two active interior window panels can be opened or closed vertically;

d. said two active exterior window panels and said two active interior window panels define an air pressure chamber therebetween;

e. a first slidable insect/solar screen and a second slidable insect/solar screen positioned in said pair of vertical parallel elongated tracks of said middle frame section and located between said two active exterior window panels and said two active interior window panels, where the slidable insect/solar screens can be slid vertically;

f. said middle frame section having a hollow chamber located all around said middle frame section with a multiplicity of perforations;

g. a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said two active exterior window panels; and h. a glass wool material inserted in said hollow chamber of said middle frame section for absorbing sound waves and preventing the flow of foreign material therethrough;

i. whereby when said two active interior window panels are opened and said two active exterior window panels are closed, the heat from the solar energy absorbed by said insect/solar screens can transfer inside said building structure, when said two active interior window panels are closed, and said two active exterior window panels are opened, the heat from the solar energy absorbed by said insect/solar screens can dissipate to outside of said building structure, when said two active interior window panels and said two active exterior window panels are opened, fresh air can ventilate said building structure, said two active interior window panels and said two active exterior window panels are closed, the inside of said building structure is isolated from the outside of said building structure, and any audible vibrations between said two active interior window panels and said two active exterior window panels are partially absorbed by said glass wool material.

10. The invention as defined in claim 9 further comprising means for mounting said common frame to a wall opening of said building structure.

11. The invention as defined in claim 9 further comprising glides attached to said two active exterior window panels and said two active interior window panels for allowing said two active exterior window panels and said two active interior window panels to slide vertically up and down.

12. The invention as defined in claim 9 further comprising glazing gaskets located on said two active exterior window panels and said two active interior window panels at opposite locations for sealing said window panels.

13. The invention as defined in claim 9 further comprising a lock and a sliding bolt located on said two active exterior window panels and said two active interior window panels for locking and holding said two active exterior window panels and said two active interior window panels.

14. The invention as defined in claim 9 wherein said two active exterior window panels and said two active interior window panels are single glazing glasses.

15. The invention as defined in claim 9 wherein said multiplicity of weep holes are shielded by a horizontal member of a sill to prevent rain from running down over said multiplicity of weep holes.

16. The invention as defined in claim 9 wherein said pair of vertical parallel elongated tracks of said middle frame section are made of PVC plastic.

17. A double window apparatus, comprising:

a. a frame having a top member, a bottom member and two side members, the frame including an exterior section, a middle section and an interior section;

b. at least one exterior window positioned in said exterior section of said frame, where the at least one exterior window can be opened or closed;

c. at least one interior window position in said interior section of said frame, where the at least one interior window can be opened or closed;

d. said at least one exterior window and said at least one interior window define a pressure chamber therebetween;

e. at least one screen positioned in said middle section of said frame, where the at least one screen is located between said at least one exterior window and said at least one interior window;

f. said middle section having a hollow chamber located all around said frame with a multiplicity of perforations;

g. means for allowing air to flow through to said pressure chamber, said pressure chamber opens to the outside atmosphere, where said pressure chamber reduces water entry through said at least one exterior window; and h. an acoustic absorbent material inserted in said hollow chamber of said middle section for absorbing sound waves and preventing the flow of foreign material from said at least one exterior window to said at least one interior window;

i. whereby when said at least one interior window is opened and said at least one exterior window is closed, the heat from the solar energy absorbed by at least one screen can transfer inside said structure, when said at least one interior window is closed and said at least one exterior window is opened, the heat from the solar energy absorbed by said at least one screen can dissipate to outside of said structure, when said at least one interior and exterior windows are opened, fresh air can ventilate said structure, and when said at least one interior and exterior windows are closed, the inside of said structure is isolated from the outside of said structure, and any audible vibrations between said at least one interior and exterior windows are partially absorbed by said acoustic absorbent material.

18. The invention as defined in claim 17 further comprising glazing gaskets located on said at least one exterior and interior windows.

19. The invention as defined in claim 17 further comprising a lock and a pull handle located on said at least one exterior and interior windows for locking and opening said at least one exterior and interior windows.

20. The invention as defined in claim 17 wherein said at least one exterior and interior windows are single glazing glass.

21. The invention as defined in claim 17 wherein said at least one screen is an insect/solar screen.

22. The invention as defined in claim 17 wherein said means for allowing air to flow through to said pressure chamber includes a multiplicity of weep holes, the multiplicity of weep holes shielded by a horizontal member of a sill to prevent rain from running down over the multiplicity of weep holes.

23. A double horizontal window apparatus for a building structure, comprising:

a. a generally rectangular common frame having a top frame member, a bottom frame member and two opposite lateral frame members, the common frame including an exterior frame section, a middle frame section and an interior frame section, each having a pair of parallel elongated tracks;

b. an inactive exterior window panel and an active exterior window panel positioned in said pair of parallel elongated tracks of said exterior frame section, where the active exterior window panel can be opened or closed horizontally;

c. an inactive interior window panel and an active interior window panel positioned in said pair of parallel elongated tracks of said interior frame section, where the active interior window panel can be opened or closed horizontally;

d. said exterior window panels and said interior window panels define an air pressure chamber therebetween;

e. a first slidable insect/solar screen and a second slidable insect/solar screen positioned in said pair of parallel elongated tracks of said middle frame section and located between said exterior window panels and said interior window panels, where the slidable insect/solar screens can be slid horizontally;

f. said middle frame section having a hollow chamber located all around said middle frame section with a multiplicity of perforations;

g. a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said exterior window panels; and h. a glass wool material inserted in said hollow chamber of said middle frame section for absorbing sound waves and preventing the flow of foreign material therethrough;

i. whereby when said active interior window panel is opened and said active exterior window panel is closed, the heat from the solar energy absorbed by said insect/solar screens can transfer inside said building structure, when said active interior window panel is closed and said active exterior window panel is opened, the heat from the solar energy absorbed by said insect/solar screens can dissipate outside of said building structure, when said active interior and exterior windows are both opened, fresh air can ventilate said building structure, and when said active interior and exterior windows are both closed, the inside of said building structure is isolated from the outside of said building structure, and any audible vibrations between said interior and exterior window panels are partially absorbed by said glass wool material.

24. A double vertical window apparatus for a building structure, comprising:

a. a generally rectangular common frame having a top frame member, a bottom frame member and two opposite lateral frame members, the common frame including an exterior frame section, a middle frame section and an interior frame section, each having a pair of parallel elongated tracks;

b. an inactive exterior window panel and an active exterior window panel positioned in said pair of parallel elongated tracks of said exterior frame section, where the active exterior window panel can be opened or closed vertically;

an inactive interior window panel and an active interior window panel positioned in said pair of parallel elongated tracks of said interior frame section, where the active interior window panel can be opened or closed vertically;

d. said exterior window panels and said interior window panels define an air pressure chamber therebetween;

e. a first slidable insect/solar screen and a second slidable insect/solar screen positioned in said pair of parallel elongated tracks of said middle frame section and located between said exterior window panels and said interior window panels, where the slidable insect/solar screens can be slid vertically;

f. said middle frame section having a hollow chamber located all around said middle frame section with a multiplicity of perforations;

g. a multiplicity of weep holes located on said exterior frame section adjacent to said bottom frame member for allowing air to flow through to said air pressure chamber, said air pressure chamber opens to the outside atmosphere through the multiplicity of weep holes, where said air pressure chamber reduces water entry through said exterior window panels; and h. a glass wool material inserted in said hollow chamber of said middle frame section for absorbing sound waves and preventing the flow of foreign material therethrough;

i. whereby when said active interior window panel is opened and said active exterior window panel is closed, the heat from the solar energy absorbed by said insect/solar screens can transfer inside said building structure, when said active interior window panel is closed, and said active exterior window panel is opened, the heat from the solar energy absorbed by said insect/solar screens can dissipate to outside of said building structure, when said active interior and exterior windows are both opened, fresh air can ventilate said building structure, said active interior and exterior windows are both closed, the inside of said building structure is isolated from the outside of said building structure, and any audible vibrations between said interior and exterior window panels are partially absorbed by said glass wool material.

25. A double window apparatus, comprising:

a. a common frame for mounting an exterior window, an interior window and a screen therebetween, both the exterior and the interior windows being individually openable or closable;

b. said frame having means for equalizing the air pressure between said exterior and interior windows to that of the outside atmosphere, to reduce water leakage through said exterior window; and c. said frame further having a perforated hollow chamber located within said frame and around said screen and filled with an acoustic absorbent material for absorbing acoustic vibration to reduce noise transmitted through said double window apparatus.

26. The invention as defined in claim 25 wherein said means for equalizing the air pressure includes a multiplicity of weep holes in said common frame, located adjacent to said exterior window.

27. A double window apparatus, comprising:

a. a common frame for mounting an exterior window, an interior window and a screen therebetween, both the exterior and the interior windows being individually openable or closable;

b. said screen further having means for absorbing solar energy and transferring the solar energy inside the building or dissipating the solar energy outside the building; and c. said frame having means for absorbing acoustic vibration to reduce noise transmitted through said double window apparatus.

28. The invention as defined in claim 27 wherein said means for absorbing acoustic vibration includes a perforated chamber within said frame, located around said screen and filled with an acoustic absorbent material.

* * * * *